US005183555A

United States Patent [19]

Forester et al.

[11] Patent Number: 5,183,555

[45] Date of Patent: Feb. 2, 1993

[54] METHOD FOR CONTROLLING FOULING DEPOSIT FORMATION IN A LIQUID HYDROCARBONACEOUS MEDIUM

[75] Inventors: David R. Forester, Conroe; Paul V. Roling, Spring, both of Tex.

[73] Assignee: Betz Laboratories, Inc., Trevose, Pa.

[21] Appl. No.: 751,947

[22] Filed: Aug. 29, 1991

[51] Int. Cl.[5] ..... C10G 9/12; C10G 9/16

[52] U.S. Cl. ..... 208/48 AA; 208/48 R; 585/950

[58] Field of Search ..... 208/48 R, 48 AA; 585/950

[56] References Cited

U.S. PATENT DOCUMENTS

| | | | |
|---|---|---|---|
| Re. 26,330 | 1/1968 | Colfer | 208/43 |
| 3,172,892 | 3/1965 | Le Suer et al. | 260/326.5 |
| 4,248,719 | 2/1981 | Chafetz et al. | 252/34 |
| 4,435,273 | 3/1984 | Ferm et al. | 208/48 AA |
| 4,578,178 | 3/1986 | Forester | 208/48 |
| 4,619,756 | 10/1986 | Dickakian | 208/48 |
| 4,775,459 | 10/1988 | Forester | 208/48 |
| 4,804,456 | 2/1989 | Forester | 208/48 |
| 4,828,674 | 5/1989 | Forester | 408/48 |

*Primary Examiner*—Theodore Morris
*Assistant Examiner*—Walter D. Griffin
*Attorney, Agent, or Firm*—Alexander D. Ricci; Philip H. Von Neida

[57] ABSTRACT

Glyoxylic acid/alkylphenol derivatives of polyalkenylsuccinimides are used as effective antifoulants in liquid hydrocarbonaceous mediums, such as crude and gas oil distillates during processing of such liquids at elevated temperatures.

8 Claims, No Drawings

METHOD FOR CONTROLLING FOULING DEPOSIT FORMATION IN A LIQUID HYDROCARBONACEOUS MEDIUM

FIELD OF THE INVENTION

The present invention pertains to the use of glyoxylic acid/alkylphenol derivatives of polyalkenylsuccinimides to inhibit fouling in liquid hydrocarbonaceous mediums during the heat treatment processing of the medium, such as in refinery processes.

BACKGROUND OF THE INVENTION

In the processing of petroleum hydrocarbons and feedstocks, such as petroleum processing intermediates, and petrochemicals and petrochemical intermediates, e.g., gas, oils, and reformer stocks, chlorinated hydrocarbons and olefin plant fluids, such as deethanizer bottoms, the hydrocarbons are commonly heated to temperatures of 40° C. to 550° C., frequently from 200° C. to 550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products.

In many processes, the deposits reduce the bore of conduits and vessels to impede process throughput, impair thermal transfer, and clog filter screens, valves and traps. In the case of heat exchange systems, the deposits form an insulating layer upon the available surfaces to impede heat transfer and necessitate frequent shut-downs for cleaning. Moreover, these deposits reduce through-put, which of course results in a loss of production capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formation which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

The present invention provides for methods of inhibiting fouling in heated liquid hydrocarbon mediums comprising adding to said hydrocarbon medium an antifoulant amount of a glyoxylic acid/alkylphenol derivative of polyalkenylsuccinimides. Typically, such antifoulant protection is provided during heat processing of the medium, such as in refinery, purification, or production processes.

DESCRIPTION OF THE RELATED ART

U.S. Pat. No. 4,828,674, Forester, May 1989 teaches a method for inhibiting the formation of fouling deposits in liquid hydrocarbonaceous mediums. An alkyl phosphonate phenate sulfide compound which is formed from the reaction of an alkyl phenol sulfide and phosphoric acid is the antifoulant compound.

U.S. Pat. No. 4,578,178, Forester, March 1986 discloses a method for controlling the formation of fouling deposits in a petroleum hydrocarbon during processing at elevated temperatures. The antifoulant compound used is a polyalkenylthiophosphonic acid or ester thereof.

U.S. Pat. No. 4,619,756, Dickakian, Oct. 1986 discloses a process for inhibiting deposit formation on surfaces in contact with a heated hydrocarbon fluid. This process employs a dispersant such as polyisobutylene succinimides of polyalkylene polyamines or polyisobutenylsuccinic anhydride esterified with a polyol.

U.S. Pat. No. 4,248,179, Chafetz et al., Feb. 1981 discloses a quaternary ammonium salt suitable as a detergent-dispersant in lubricating oils. This composition employs the reaction product of an alkenylsuccinic anhydride and an amine as starting compounds.

U.S. Pat. No. 3,172,892, LeSeur et al., Mar. 1965 teaches an oil-soluble produce which is used as a dispersing agent in lubricating compositions. The product is prepared by reacting substituted succinic acids with substituted succinic anhydrides to form an alkenylsuccinic anhydride.

U.S. Pat. No. 4,775,459, Forester, Oct. 1988, and U.S. Pat. No. 4,804,456, Forester, Feb. 1989 disclose methods for controlling the formation of fouling deposits in petroleum hydrocarbons employing Group II(a) cation salts and amine salts of polyalkenylthiophosphonic acid, respectively.

DETAILED DESCRIPTION OF THE INVENTION

The present invention pertains to a method of inhibiting fouling deposit formation in a liquid hydrocarbonaceous medium during heat treatment processing thereof, wherein the absence of such antifouling treatment, fouling deposits are normally formed as a separate phase within said liquid hydrocarbonaceous medium thereby impeding process throughput and thermal transfer, said method comprising adding to said liquid hydrocarbonaceous medium an antifouling amount of a glyoxylic acid/alkylphenol derivative of a polyalkenylsuccinimide.

It is to be understood that the phrase "liquid hydrocarbonaceous medium" as used herein signifies various and sundry petroleum hydrocarbons and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The glyoxylic acid/alkylphenol derivatives of polyalkenylsuccinimide useful in this invention are generally prepared from the reaction of polyalkenylsuccinic anhydride with a polyamine with attendant heating to drive off water so as to form the requisite polyalkenylsuccinimide intermediate. After the intermediate is formed, an alkylphenol such as para-nonylphenol, is added with heating and this mixture is then reacted with glyoxylic acid under an inert atmosphere in a non-polar organic solvent, such as toluene, xylene, benzene, etc.

More specifically, the starting reactant, polyalkenyl succinic anhydride, may be purchased commercially or prepared. The polyalkenylsuccinic anhydride (PASA) has the general structure

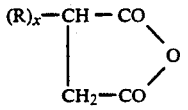

wherein, R is an alkenyl repeat unit. The average molecular weight of the polyalkenylene used to produce the PASA may be from 500 to 3000, with the preferred range being 1000 to 2000.

The precursor polyalkenylsuccinic anhydride may also be prepared as reported in U.S. Pat. No. Re. 26,330 (Colfer) which is wholly incorporated by reference. As is stated in the '330 patent, the anhydrides may be prepared by reaction of maleic anhydride with a high molecular weight olefin or a chlorinated high molecular weight olefin at reaction temperatures of from 150° to 200° C.

Even though for the most part, the R grouping comprises an alkenyl moiety, colfer points out that this substituent can be either an aliphatic alkyl or alkenyl moiety. For ease of reference and for the purpose of this application, the compounds having such R grouping are referred to herein as polyalkenyl compounds, although in the strict sense they should be referred to as aliphatic alkyl or alkenyl moieties.

The most commonly used sources for forming the aliphatic R substituent on the succinic anhydride compound are the polyolefins such as polyethylene, polypropylene, polyisobutene, polyamylene, polyisohexylene, etc. The most particularly preferred polyolefin is polyisobutene. As Colfer states, particular preference is made for such a polyisobutene-containing at least about 50 carbon atoms, preferably from at least 60 carbon atoms and most desirably from about 100 to about 130 carbon atoms. Accordingly, an operable carbon atom number range for R is from about 30 to 200 carbon atoms.

Once the polyalkenylsuccinic anhydride precursor is obtained, it is reacted with a polyamine, as reported in Colfer, at a temperature in excess of about 80° C. so as to form an imide. More specifically, the polyalkenylsuccinic anhydride

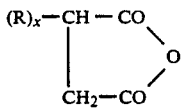

(I)

wherein R is an aliphatic alkenyl or alkyl moiety having at least about 50 carbon atoms and less than about 200 carbon atoms, is reacted with a polyamine having the structure

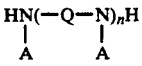

(II)

in which n is an integer, A is chosen from hydrocarbyl, hydroxyalkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is $C_1$ to $C_5$ alkylene, such as ethylene, trimethylene, tetramethylene, etc. Q is most preferably ethylene.

Accordingly, exemplary amine components may comprise ethylenediamine, triethylenetetramine, diethylenetriamine, trimethylenediamine, bis(trimethylene)triamine, tris(trimethylene)tetramine, tris(hexamethylene)tetramine, decamethylenediamine, N-octyltrimethylenediamine, N,N'-dioctyltrimethylenediamine, N-(2-hydroxyethyl)ethylenediamine, piperazine, 1,4-bis(2-aminoethyl)piperazine, 1-(2-hydroxyethyl)piperazine, bis(hydroxypropyl) substituted tetraethylenepentamine, N-3-(hydroxypropyl)tetramethylenediamine, pyrimidine, 2-methylimidazoline, polymerized ethyleneimine, and 1,3-bis(2-aminoethyl-)imidazoline.

The reaction of precursor polyalkenylsuccinic anhydride with amine (II) is conducted at temperatures in excess of 80° C. with the use of a solvent, such as benzene, xylene, toluene, naphtha, mineral oil, n-hexane, etc. Preferably, the reaction is conducted at from 100° C. to 250° C. with a molar amount of precursor anhydride (I): amine (II) being from about 1:1.

The polyalkenylsuccinimide so obtained will have predominantly the structure

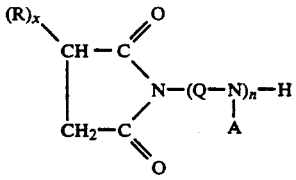

(III)

wherein R, Q, A, x and n are as previously defined in connection with structural formulae I and II.

After the polyalkenylsuccinimide precursor has been obtained, an alkylphenol such as para-nonylphenol, p-cresol, p-ethylphenol, p-t-butylphenol, p-t-amylphenol, p-octylphenol and p-dodecylphenol is added. This mixture is then reacted with glyoxylic acid at temperatures from about 110° C. to about 160° C.

One of the resulting products of the reaction of glyoxylic acid/alkylphenol with the polyalkenylsuccinimide is expected to have the formula

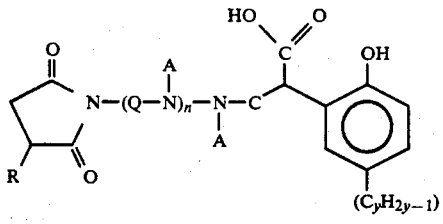

wherein R is an aliphatic alkyl group or alkenyl group with from about 30 to about 200 carbon atoms and Q, A, and n are as previously defined in connection with structural Formula II. Y is a positive integer between 1 and 20, preferably between 3 and 12.

At present, preliminary studies have indicated surprisingly effective antifouling inhibition results with a glyoxylic acid/alkylphenol derivative of a polyalkenylsuccinimide formed with a 1:1 molar ratio of polyisobutenylsuccinic anhydride (MW of isobutenyl moiety-1300) and triethylenetetramine.

The glyoxylic acid/alkylphenol derivatives of a polyalkenylsuccinimide useful in the invention may be added to or dispersed within the liquid hydrocarbonaceous medium in need of antifouling protection in an amount of 0.5 parts per million to about 10,000 parts per million based upon one million parts of the liquid hydrocarbonaceous medium. Preferably, the antifoulant is added in an amount of about 1 to about 2500 parts per one million parts of the liquid hydrocarbonaceous medium.

The succinimide derivatives may be dissolved in a polar or non-polar organic solvent, such as heavy aromatic naphtha, toluene, xylene, or mineral oil and fed to the requisite hot process fluid or they can be fed neat thereto. These derivatives are especially effective when added to the liquid hydrocarbonaceous medium during the heat processing thereof at temperatures of from 200° C. to 550° C.

The following examples are included as being illustrative of the invention and should not be construed as limiting the scope thereof.

DETAILED DESCRIPTION OF THE PREFERRED EMBODIMENT

Preparation of the Succinimide Derivatives

In a 250 ml three-necked, round bottom flask equipped with thermometer, magnetic stirrer, Dean-Stark trap and septum were mixed with stirring 29.1 grams (0.01 mole) of a 45% active, 1300 molecular weight polyisobutenylsuccinic anhydride (PIBSA), 25.0 ml of xylene, and 1.46 grams (0.01 mole) of triethylenetetramine (TETA).

This mixture was heated to 155° C. for approximately 2 hours, then allowed to cool to 77° C. 2.20 grams (0.01 mole) of para-nonylphenol were then added with 20 ml of xylene to the PIBSA/TETA reaction product.

The mixture was heated to 110° C. with stirring over 2 hours while 1.1 ml of a 50% glyoxylic acid in water solution was added by syringe pump. Stirring was continued at 110° C. for 2 more hours. The pot temperature was then raised to 160° C. over 1.5 hours and about 0.5 ml of water and 17 ml of xylene were collected in a Dean-Stark trap. The resulting solution amounted to 52.7 grams of product (about 33% active) and was designated PIBSPG.

Fouling Apparatus Tests

In order to ascertain the antifoulant efficacy of the antifoulant treatment in accordance with the invention, process fluid is pumped from a Parr bomb through a heat exchanger containing an electrically heated rod. Then, the process fluid is chilled back to room temperature in a water cooled condenser before being remixed with the fluid in the bomb. The system is pressurized by nitrogen to minimize vaporization of the process fluid.

The Dual Fouling Apparatus (DFA) used to generate the data shown in the following Table I contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\frac{\text{Avg. } \Delta \text{ Area(control)} - \Delta \text{ Area(treatment)}}{\text{Avg. } \Delta \text{ Area(control)}} * 100 = \%\ \text{protection}$$

TABLE I

| Dual fouling apparatus test Percent protection for PIBSPG U.S. Mid-Continent Refinery | | |
|---|---|---|
| Rod Temperature (°C.) | Treatment Dosage (ppm active) | Percent Protection |
| 482 | 62 | 51,−25,27 (18 avg.) |
| 482 | 250 | 22 |
| 496 | 250 | 40 |
| Gulf Coast Refinery Crude Oil | | |
| 427° C. | 250 | 36 |

PIBSPG = polyisobutenylsuccinimide phenol glyoxylic acid

The Hot Filament Fouling Test (HFFT) used to generate the data in Table II used a preweighed 24-gauge Ni-chrome wire placed between two brass electrodes in a glass reaction jar and held in place by two brass screws. 200 ml of feedstock are measured and added into each sample jar. One sample jar is left untreated as a control with other jars being supplied with 125 parts per million (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125° to 150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{Wt. Deposit} = \left(\begin{matrix}\text{Weight of wire}\\ \text{plus deposit}\end{matrix}\right) - \text{original wire weight}$$

The percentage protection for each treatment sample was then calculated as follows:

$$\%\ \text{Protection} = \left[1 - \frac{\text{wt. deposit (treated)}}{\text{wt. deposit (untreated)}}\right] \times 100$$

The results of this testing are presented in Table II.

TABLE II

| Treatment Agent | Dosage (ppm) | Feedstock Type | % Protection |
|---|---|---|---|
| PIBSPG | 125 | SRLGO | 80 |
| PIBSPG | 125 | CCLGO | 93 |

PIBSPG = polyisobutenylsuccinimide phenol glyoxylic acid
SRLGO = straight run light gas oil (Midwestern Refinery)
CCLGO = catalytic cracked light gas oil (Midwestern Refinery)

As the examples clearly indicate, the succinimide derivatives of the present invention provide significant fouling inhibition in process crude and gas oil distillates.

The antifoulants of the invention may be used in any system wherein a petrochemical or hydrocarbon is processed at elevated temperatures, and wherein it is desired to minimize the accumulation of unwanted matter on heat transfer surfaces. For instance, the antifoulants may be used in fluid catalytic cracker unit slurry systems wherein it is common to employ significant amounts of inorganic catalyst in the hydrocarbon containing process stream.

In accordance with the patent statutes, the best mode of practicing the invention is set forth. However, it will be apparent to those skilled in the art that many other modifications can be made without departing from the invention herein disclosed and described, the scope of the invention being limited only by the scope of the attached claims.

Having thus described the invention, what we claim is:

1. A method for inhibiting fouling deposit formation in a liquid hydrocarbonaceous medium during heat treatment processing thereof at temperatures from 200° C. to 550° C., wherein in the absence of such antifouling treatment, fouling deposits are normally formed as a separate phase within said liquid hydrocarbonaceous medium thereby impeding process throughput and thermal transfer, said method comprising adding to said liquid hydrocarbonaceous medium about 0.5 parts to about 1,000 parts per million parts hydrocarbonaceous medium of a glyoxylic acid/alkylphenol derivative of a polyalkenylsuccinimide containing an aliphatic alkyl group or alkenyl group with from about 50 to about 200 carbon atoms.

2. The method as claimed in claim 1 wherein said liquid hydrocarbonaceous medium comprises crude oil, straight run light gas oil, or catalytically cracked light gas oil.

3. The method as claimed in claim 1 wherein said polyalkenyl moiety is a repeated isobutenyl moiety.

4. A method of inhibiting fouling deposit formation in a liquid hydrocarbonaceous medium during heat treatment processing thereof at temperatures from 200° C. to 550° C., wherein in the absence of such antifouling treatment, fouling deposits are normally formed as a separate phase within said liquid hydrocarbonaceous medium thereby impeding process throughput and thermal transfer, said method comprising adding to said liquid hydrocarbonaceous medium about 0.5 parts to about 10,000 parts per million parts hydrocarbonaceous medium of a polyalkenylsuccinimide having the formula:

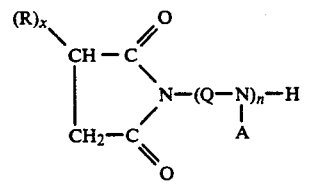

wherein R is an aliphatic alkenyl or alkyl moiety having at least about 50 carbon atoms and less than about 200 carbon atoms, Q is a divalent aliphatic radical, n is a positive integer, A is a hydrocarbyl, hydroxyalkyl or hydrogen, with paranonylphenol and glyoxylic acid.

5. The method as claimed in claim 4 wherein said liquid hydrocarbonaceous medium comprises crude oil, or straight run light gas oil, catalytically cracked light gas oil.

6. The method as claimed in claim 4 wherein R comprises a repeated isobutenyl moiety.

7. The method as claimed in claim 4 wherein Q is chosen from $C_1$ to $C_5$ alkylene and A is hydrogen.

8. The method as claimed in claim 7 wherein Q is ethylene.

* * * * *